United States Patent [19]

Beard et al.

[11] 4,144,786

[45] Mar. 20, 1979

[54] ENVELOPE EDGE SLITTING APPARATUS

[75] Inventors: James D. Beard, Independence; Gene F. Beck, Parkville, both of Mo.

[73] Assignee: Stephens Industries, Inc., Lenexa, Kans.

[21] Appl. No.: 847,499

[22] Filed: Nov. 1, 1977

Related U.S. Application Data

[63] Continuation of Ser. No. 679,560, Apr. 23, 1976, abandoned.

[51] Int. Cl.[2] ..... B26D 1/24; B26D 7/06; B65B 43/12; B65H 3/04

[52] U.S. Cl. ..... 83/732; 53/381 R; 83/417; 83/418; 83/912; 271/35

[58] Field of Search ..... 83/498, 499, 501, 417, 83/418, 508.2, 912, 732; 53/381 R; 271/35

[56] References Cited

U.S. PATENT DOCUMENTS

| | | | |
|---|---|---|---|
| 2,027,045 | 1/1936 | Keiser | 83/499 X |
| 2,106,191 | 1/1938 | Ryan | 83/498 X |
| 2,157,232 | 5/1939 | Dummer et al. | 83/912 X |
| 2,907,567 | 10/1959 | Schneider et al. | 271/35 |
| 3,132,629 | 5/1964 | Krupotich | 83/912 X |
| 3,301,116 | 1/1967 | Owen | 83/912 X |
| 3,381,564 | 5/1968 | Whiteford | 83/912 X |
| 3,603,190 | 9/1971 | Kollen | 83/499 |
| 3,691,726 | 9/1972 | Stephens et al. | 83/912 X |
| 3,867,860 | 2/1975 | Haug | 83/912 X |
| 3,943,807 | 3/1976 | Bingham et al. | 83/417 X |

*Primary Examiner*—Horace M. Culver
*Attorney, Agent, or Firm*—Shenier & O'Connor

[57] ABSTRACT

In an envelope edge slitter having a base, apparatus for feeding the envelopes one-by-one from the bottom of a stack at an input station to slitter blades in which an endless elastic belt extending around an eccentric pulley has an upper reach disposed in a slot n the base at the input station. The eccentricity of the pulley alternately brings the belt into and out of engagement with the lowermost envelope in the stack while the elasticity of the belt, the eccentricity of the pulley and the speed with which the belt is driven are such as to produce a whipping action of the upper reach of the belt which ensures that adjacent envelopes of the stack are separated and are fed one-by-one to the slitter blades.

5 Claims, 6 Drawing Figures

ENVELOPE EDGE SLITTING APPARATUS

This is a continuation of application Ser. No. 679,560, filed Apr. 23, 1976 now abandoned.

BACKGROUND OF THE INVENTION

This invention relates to an apparatus for slitting the top edges of envelopes supplied in the form of a stack.

Machines for automatically slitting envelopes along their top edges are known in the prior art. Generally, these machines comprise a base plate having one or more cutting wheels disposed at one end thereof and having one or more endless conveyor belts mounted in slots formed in the base for moving envelopes through the cutting wheels. One such machine is shown in U.S. Pat. No. 3,691,726, issued to Stephens et al. It is highly desirable that these machines proces envelopes rapidly, yet operate reliably. To some extent, however, these design objectives are incompatible. In particular, it has been found that when envelopes are fed to the cutting wheels too rapidly, the envelopes tend to jam the cutting wheels, resulting in possible machine malfunction and multilation of the envelope contents. More specifically, it often occurs that adjacent envelopes of the stack are not separated as they are removed from the bottom of the stack so that more than one envelope at a time is fed to the slitter blades.

SUMMARY OF THE INVENTION

One of the objects of our invention is to provide an envelope slitter which processes envelopes rapidly.

Another object of our invention is to provide an envelope slitter which operates reliably.

Still another object of our invention is to provide an envelope slitter which is mechanically simple.

A further object of our invention is to provide an envelope slitter which ensures that adjacent envelopes at the bottom of the stack are separated and fed from the stack one-by-one to the slitter blades.

Other and further objects of our invention will be apparent from the following description.

In general, our invention contemplates an envelope-slitting apparatus in which a base plate is provided with a feed end for accepting a stack of envelopes and a cutting end at which the top edges of the envelopes are cut. Envelopes are retained at the feed end by a holding means which restricts the passage of all except the lowermost envelope of the stack and are moved to the cutting end by an endless elastic belt disposed in a slot formed in the base plate. The belt is supported at the feed end of the machine by an eccentrically mounted pulley which is driven to move the belt into and out of engagement with the lowermost envelope of the stack. The elasticity of the belt, the eccentricity of the pulley and the speed at which the belt is driven are so selected as to produce a whipping action of the belt on the lowermost envelope to ensure its separation from the envelope immediately thereabove as it is fed to the slitters. This "whipping" action of the belt further to be described, provides a rapid and reliable envelope feed system which is relatively free from the problems associated with systems of the prior art.

DESCRIPTION OF THE PREFERRED EMBODIMENT

Figure 5:
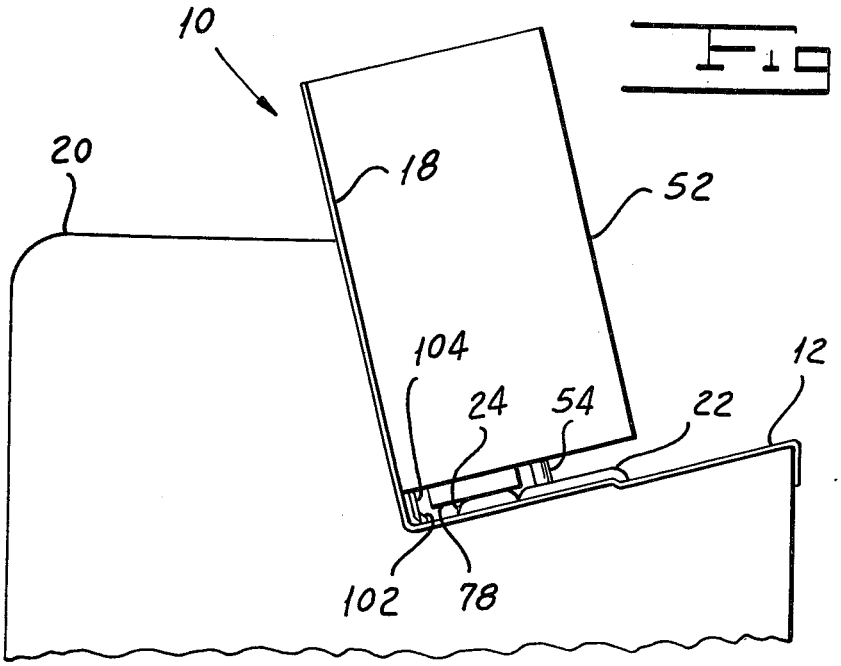
FIG. 5 is a fragmentary left end elevation of our edge slitting apparatus.

Referring now to the drawing, our edge slitter, indicated generally by the reference numeral 10, includes a generally horizontal base plate 12 which has an input end and a cutting end indicated generally, respectively, by the reference characters 14 and 16. The plate 12 is integrally formed along one side with an upstanding edge guide 18. The edge guide 18 is also preferably formed with a forwardly extending safety shield 110 at the cutting and of the base plate 12. As can be seen by reference to FIG. 5, the plate 12 and the edge guide 18 are received in a frame 20 which inclines guide 18 rearwardly and base plate 12 upwardly.

Figure 1:
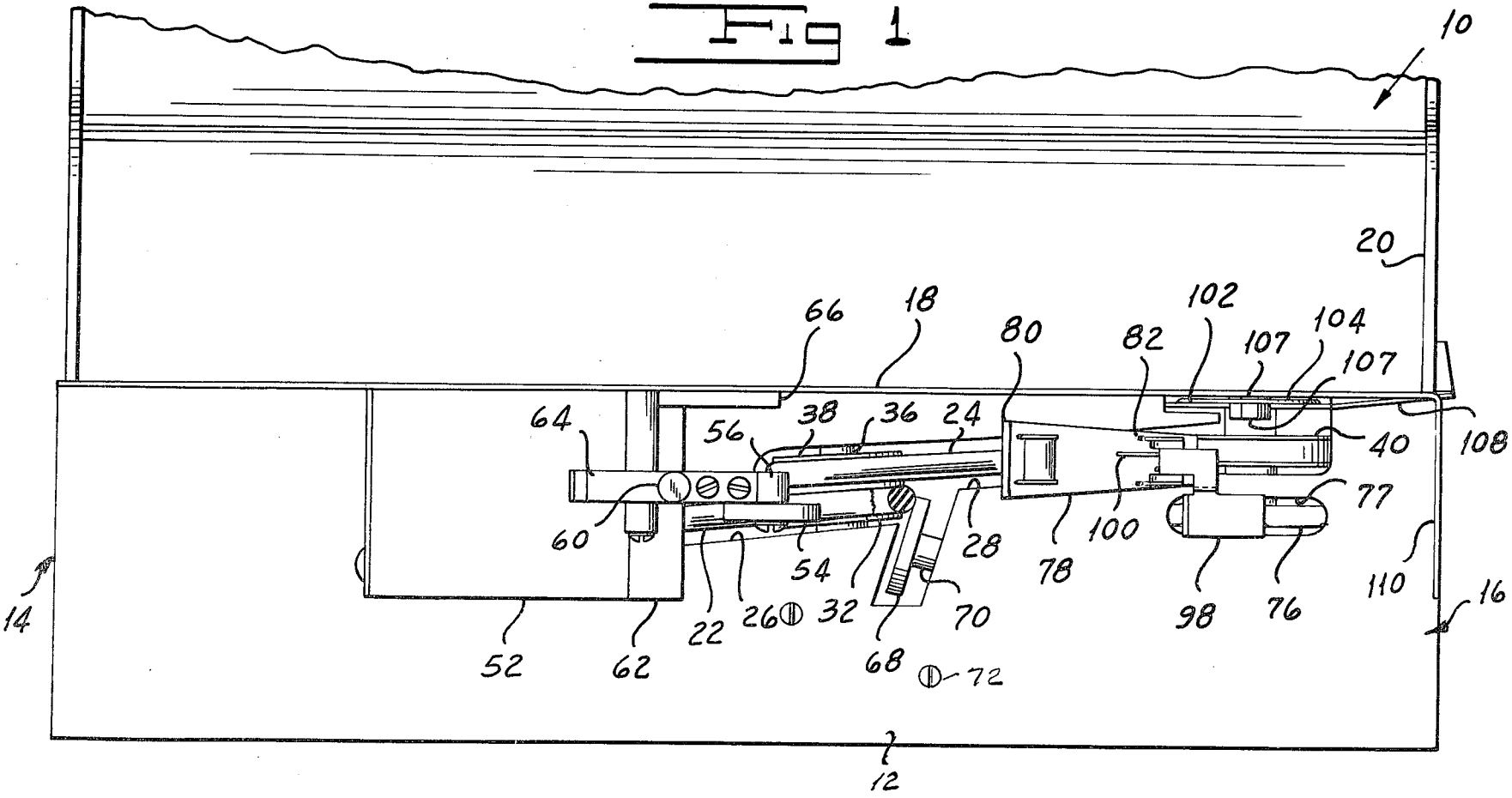
FIG. 1 is a fragmentary top plan of our envelope edge slitting apparatus.
Figures 2, 3:
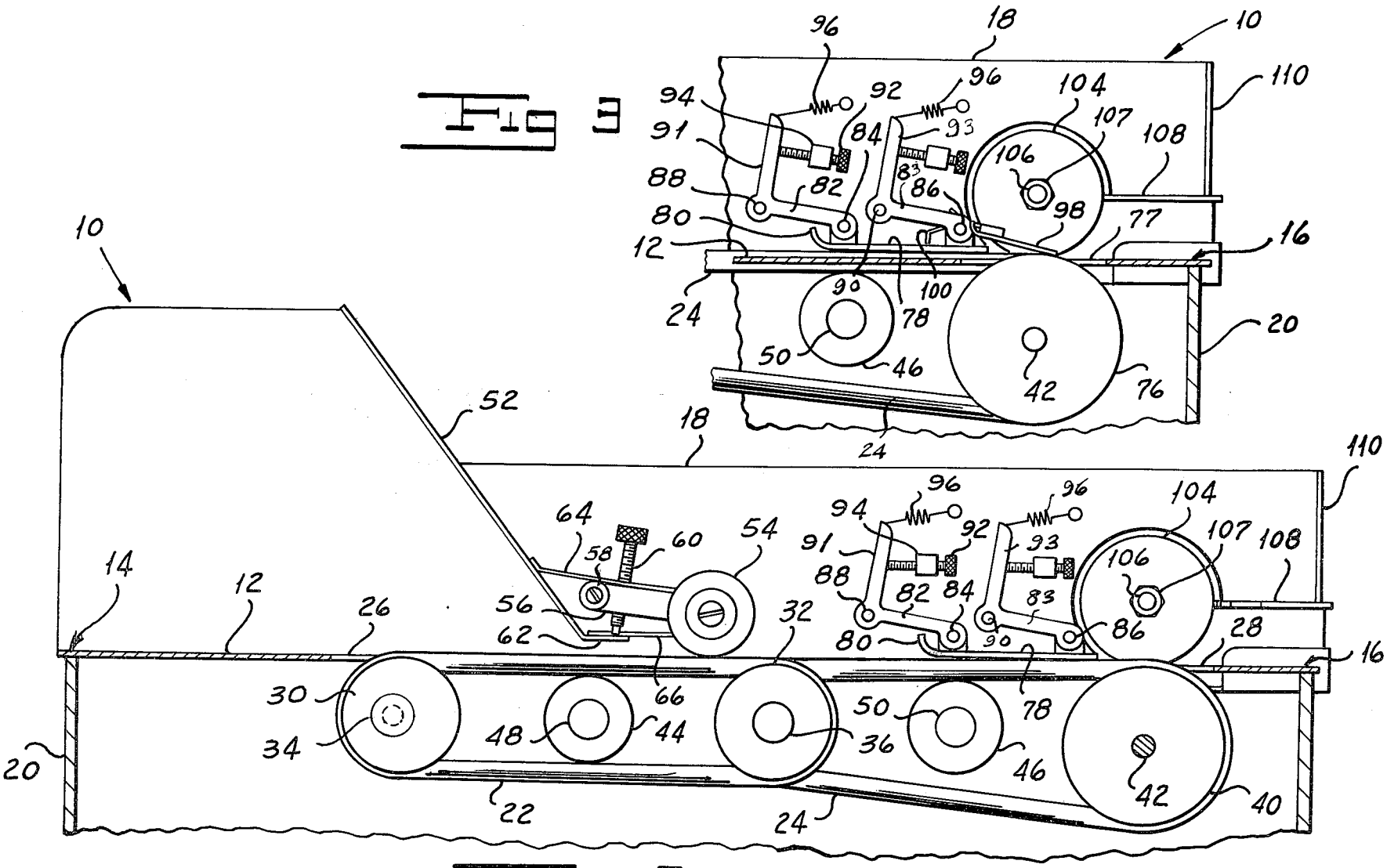
FIG. 2 is an elevation substantially from the front of the apparatus shown in FIG. 1 with parts shown in section and with other parts removed.
FIG. 3 is a fragmentary section of the apparatus showing the main pressure plate and feed wheel assembly.

Referring to FIGS. 1 and 2, envelopes are supplied to the slitter 10 at the feed end 14 in the form of a stack, the lowermost envelope of which lies flat on plate 12 and the upper edges of which extend along guide 18. A pair of endless belts 22 and 24 which are disposed in staggered relationship with one another and which extend upwardly through respective slots 26 and 28 formed in the base plate 12 engage the lowermost envelope and move the envelope one by one toward the end 16. More specifically, the first belt 22 is trained around spaced pulleys 30 and 32 mounted on respective shafts 34 and 36. We mount the pulley 30 eccentrically on shaft 34. The amount of eccentricity necessary to achieve the results of our invention will be discussed more fully hereinbelow. The pulleys 30 and 32 are disposed such that the belt 22 is inclined slightly toward edge guide 18 in a direction from the input end 14 toward the output end 16. In a similar manner, a second belt 24 is trained between pulleys 38 and 40 mounted on respective shafts 36 and 42, the pulley 38 being mounted on shaft 36 between edge guide 18 and pulley 32. Like belt 22, belt 24 is also inclined towards the edge guide 18 in the direction of the cutting or delivery end 16 of the base plate 12. A pair of idler rollers 44 and 46, carried by respective shafts 48 and 50, support the belts 22 and 24 at positions intermediate their respective end pulleys. Shaft 42 is driven in a clockwise direction, as viewed in FIG. 2, in a manner to be described. Shafts 36 and 34 are indirectly driven from shaft 42 through belts 24 and 22, respectively.

Prior to their being individually fed across the base plate 12, envelopes are retained at the feed end of the plate 12, by a retaining plate 52 disposed above the base plate 12. The retaining plate 52 extends outwardly from the edge guide 18 and upwardly towards the feed end of the base plate 52 to form a stack-receiving mouth with the base plate 12. The lower edge of plate 52 is provided with a lip 62 along its lower edge spaced from the base plate 12 by a distance at least equal to the thickness of the thickest envelope to be handled. We mount a friction disk 54 above the first belt 22 at a point just beyond the lip 62 of the retaining plate 52 in the direction of movement of the envelopes and at a location between the pulley 32 and the idler roller 44. The disk 54 is secured to one end of a pivot arm 56, the other end of which is pivoted on a pin 58 extending outwardly from guide wall 18. A leaf spring 64 secured to the pivot arm 56 bears against the upper surface of the retaining plate 52 to urge the pivot arm 56 downwardly toward a limit position determined by an adjusting screw 60 engaging the lip 62 of the retaining plate 52. In operation, the holdback disk 54 is urged toward belt 22 so as to permit only one envelope at a time to pass thereunder as belt 22 is driven. Preferably, an end guide 66 is fastened to the retaining plate lip 62 to ensure proper movement of the envelopes along the base plate 12.

Envelopes are supplied to the feed end 14 of the slitter 10 in the form of a stack with the top edges of the envelopes resting on guide plate 18. As the eccentric pulley 34 moves up and down the driven belt 22 tends to move envelopes from the bottom of the stack into the mouth 62. While mouth 62 is sufficiently large to accommodate the passage of more than one envelope of normal thickness at a time therethrough the whipping action of belt 22 ensures that the lowermost envelope of the stack is separated from the next-to-lowermost so that only the lowermost envelope enters the nip between disk 54 and belt 22. We form belt 22 from resilient rubber and without reinforcement to permit the belt to stretch and contract in the course of a rotation of eccentric pulley 30. The separation of the envelopes is ensured by the whipping action of the belt which is achieved by driving the belt at a speed sufficient for a given eccentricity and size of the drive pulley. For this purpose, the belt 22 is preferably formed with a circular cross section as shown to provide additional weight. A suitable rotational speed for a 2–¼ inch diameter pulley 30 having an eccentricity of about ⅛ inch is around 500 rpm in order to provide the desired whipping action.

Figure 4:
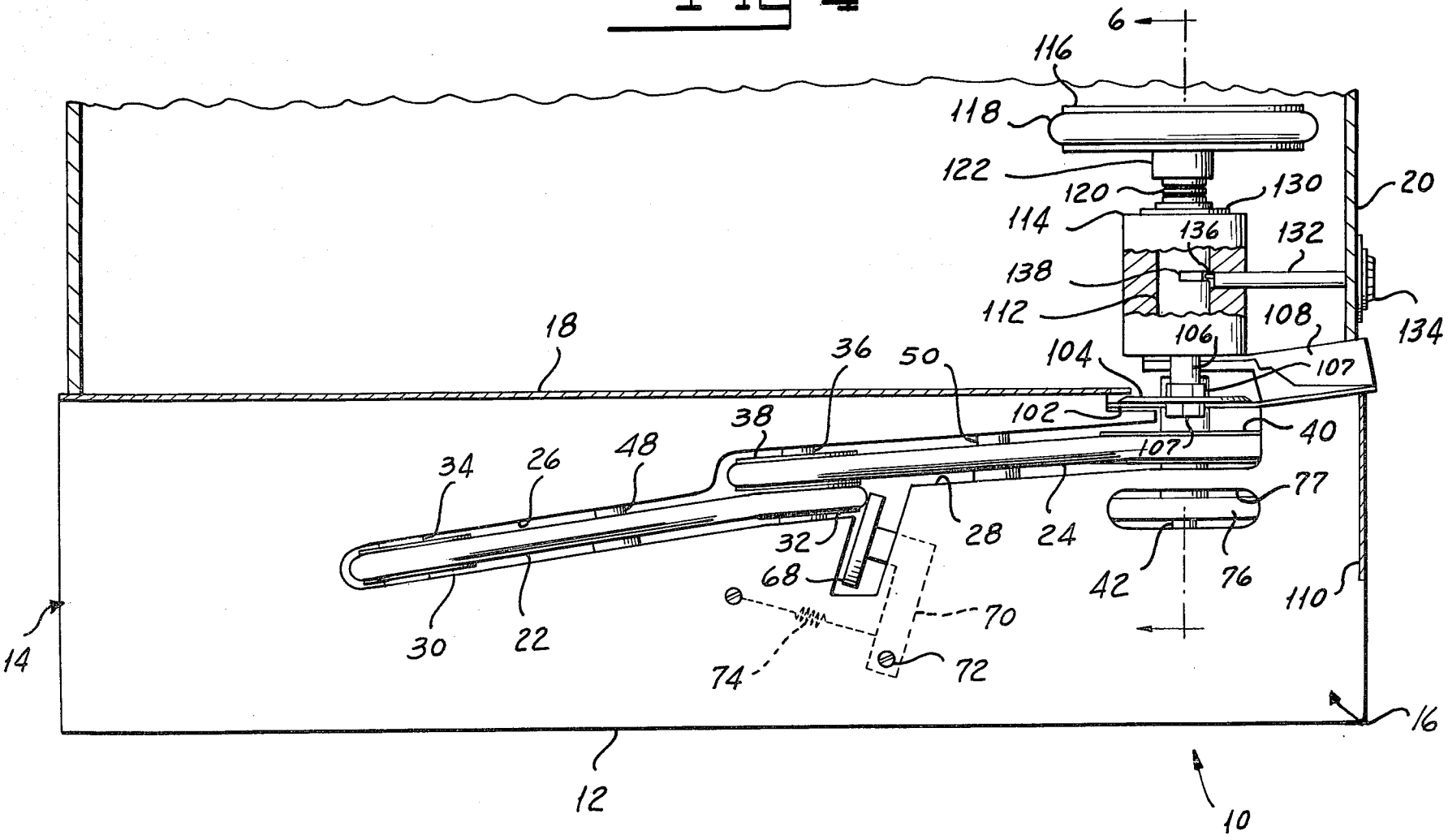
FIG. 4 is a top plan of the apparatus of FIG. 2, with some parts removed and with other parts broken away and shown in section.

Referring now to FIGS. 1 and 4, the belts 22 and 24 are assisted in urging envelopes against the edge guide 18 by means of an auxiliary friction roller 68 rotating around an axis making an angle of about 30° with respect to the edge guide 18. The roller 68, formed of a suitable frictional material, is rotatably mounted on one end of an L-shaped arm 70 supported by pivot 72. A spring 74 coupled to the arm 72 urges one side of the roller 68 against the portion of belt 22 carried by pulley 32 to frictionally drive the roller 68 in the direction to urge an envelopetoward the edge guide 18. We mount another friction feed roller 76 on the shaft 42 on the outboard side of pulley 40. Feed roller 76, which assists the movement of the envelope through the cutting wheels to be described, extends through a slot 77 provided in the base plate 12 to approximately the same height above the base plate as the belt 24.

Referring to FIGS. 1 to 3, we arrange a pressure plate 78 having an upwardly curved leading edge 80 above the second belt 24 to maintain envelopes flat against the belt 24 to ensure proper cutting. Respective pivot pins 84 and 86 connect spaced lugs on the upper surface of plate 78 to arms 82 and 83 of bell cranks supported of fulcrums 88 and 90 on guide 18. Springs 96 connected to the other arms 91 and 93 of the bell cranks urge them in clockwise direction as viewed in FIGS. 2 and 3 to limit positions provided by screws 92 threaded in blocks 94 on guide 18 and having ends adapted to engage arms 91 and 93. It will readily be appreciated that screws 92 can be adjusted to adjust the position of the plate relative to surface 12 as well as the angular orientation of the plate in the direction of its length with reference to the surface of plate 12. An additional pressure plate 98 for the feed roller 76 is pivotally mounted on pin 86 and is urged downwardly against the feed roller 76 by a spring 100 bearing between plate 78 and plate 90.

Figure 6:
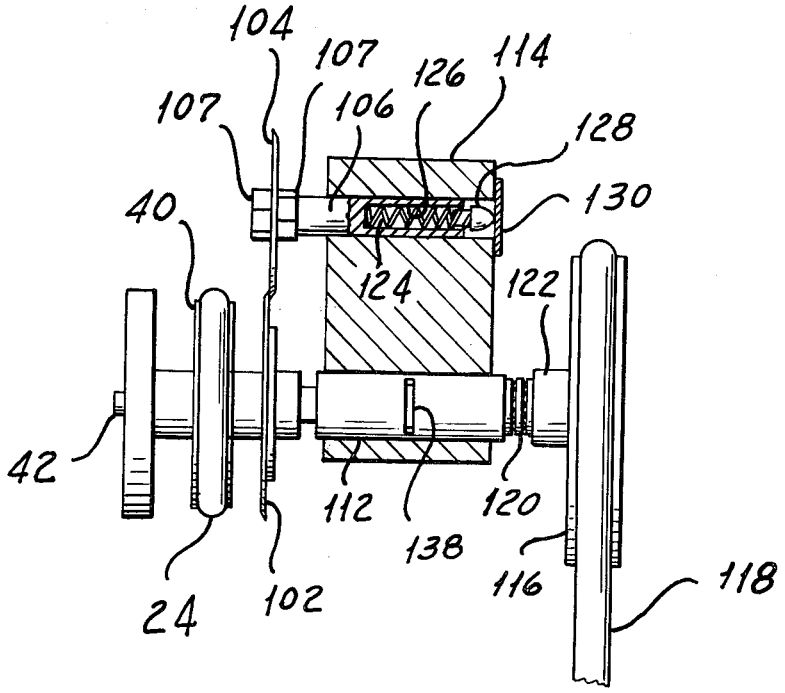
FIG. 6 is a fragmentary section taken along line 6—6 of FIG. 4, showing the cutting wheel mounting assembly of our apparatus.

Referring now to FIGS. 4 and 6, shaft 42 passes through a sleeve 112, slidably received in a mounting block 114 disposed behind the edge guide 18, to receive a pulley 116 carrying a belt 118 adapted to be driven in any suitable manner. A thrust bearing 120 separates the sleeve 112 from a hub 122 of the pulley 116. The shaft 42 also supports for rotation therewith a lower cutting wheel 102 disposed inboard of the pulley 40. Nuts 107 or the like secure an upper cutting wheel 104 on a shaft 106 in overlapping relationship with the lower cutting wheel. The upper cutting wheel shaft 106 is directly rotatably received in the mounting block 114 and is biased into engagement with blade 102 by a spring 124 located in a bore 126 formed in the shaft 106. A head on the end of the spring remote from the base of bore 126 engages a cover plate secured over the end of the bore which receives shaft 106.

In operation, the upper cutting wheel 104 is urged against the overlapping portion of the lower cutting wheel to urge the shaft 42 forward until it reaches a limit position in which the thrust bearing 120 abuts the sleeve 112 and the pulley flange 122. The position of the sleeve 112 relative to the mounting block 114 is adjusted by rotating an adjustment shaft 132 controlled by a knob 134 located on the outside of the slitter 10. The other end of the shaft 132 has a pin 136 located eccentrically thereon, the pin 136 being received in a circumferential slot 138 formed partially around the sleeve 112. By means of the above-described arrangement, the plane of contact between the lower cutting wheel 102 and the upper cutting wheel 104 may be varied from about 0 to about ⅛ inch in front of the edge guide 18. The exact cutting will depend upon the depth of cut desired. The top edge slivers cut from the envelopes by the cutting wheels 102 and 104 are directed rearwardly by means of guide 108.

In operation of our apparatus for slitting envelopes along the upper edges thereof, we first place a stack of envelopes to be slit on the table 12 above the pulley 30 and with the top edges of the envelopes resting generally against the guide 18. As the eccentric pulley rotates, it alternately moves into and out of engagement with the lowermost envelope of the stack to tend to move the lowermost envelope forwardly toward the pressure roller 54. As one or more of the envelopes in the stack enter the mouth 62 the whipping action of the belt 22 ensures that the lowermost envelope is separated from the envelope immediately above so that the leading edge of only the lowermost envelope enters the nip between the pressure disk 54 and the belt 22. As this occurs, the envelope is picked up by the belt 24 and, owing to the information of both belts 22 and 24 toward guide 18, we ensure that the upper edge of the envelope abuts guide plate 18 as it moves towards the cutting blades 102 and 104. As the envelope moves past the cutting blades, the upper edge portion thereof is slit to open the envelope and the portion of the envelope removed is directed to a suitable trash receptacle. It is to be emphasized that the speed at which the pulley 30 is driven, the elasticity of the belt 22, the tension in the belt and the amount of eccentricity of the pulley 30 are selected so as to produce the desired whipping action of the belt. It will readily be appreciated by persons of ordinary skill in the art that these factors may empirically be determined to produce the desired result of ensuring that the lowermost envelope in the stack is separated from the next to lowermost envelope.

It will be seen that we have accomplished the objects of our invention. We have provided an envelope slitting apparatus which is simple in construction and in operation. It is relatively inexpensive to construct. It is reliable in operation. It ensures that the lowermost envelope in a stack is separated from the envelope immediately thereabove to minimize the possibility of jamming of the apparatus by feeding more than one envelope at a time from the stack to the slitting apparatus.

It will be understood tht certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. In an apparatus for slitting the edges of envelopes including a base plate having a feed end for accepting a stack of said envelopes, a cutting end, and a slot formed therein running from said feed end toward said cutting end, an edge guide disposed along a lateral edge of said base plate, an endless belt, first and second pulleys supporting said endless belt in said slot, means for rotating said pulleys to move said envelopes along said base plate from the feed end toward the cutting end thereof, and means adjacent to said edge guide at said cutting end for slitting an edge of an envelope supplied thereto, the improvement comprising an auxiliary roller for urging envelopes against said edge guide and means for rotatably mounting said roller in rolling contact below said base plate with a portion of said belt trained around said second pulley and with said auxiliary roller directed at least partly toward said edge guide.

2. The improvement as claim 1 in which said mounting means resiliently biases the rim portion of said roller against said belt portion.

3. The improvement as in claim 1 in which said auxiliary roller is directed more towards said edge guide than towards said cutting end.

4. The improvement as in claim 1 in which said auxiliary roller forms an angle of about 60° with said edge guide.

5. Apparatus for slitting the edges of envelopes including in combination:

(a) a base plate for supporting said envelopes, said base plate having a feed end for accepting a stack of said envelopes, a cutting end, and an elongated slot running generally from said feed end toward said cutting end;

(b) an edge guide disposed along a lateral edge of said base plate;

(c) an endless belt of elastic material for moving said envelopes along sid base plate from the feed end toward the cutting end thereof;

(d) first and second pulleys supporting said endless belt in said elongated slot;

(e) means disposed above said endless belt for restricting the passage of all except the lowermost envelope of said stack of envelopes;

(f) means for eccentrically mounting said first pulley, said belt having an upper envelope-engaging portion of appreciable length intermediate said pulleys engaging the lower side of said stack during at least part of the rotation of said first pulley;

(g) means for driving said first pulley at a speed sufficient to produce a whipping action in said belt portion to cause said advancing belt portion to move successively into and out of contact with the lowermost envelopes of said stack with a slapping action to individually supply the same to the cutting end of said base plate, said whipping action ensuring separation of said lowermost envelope from the envelope immediately above said lowermost envelope;

(h) cutting means at said cutting end for slitting an edge of an envelope supplied thereto, said cutting means comprising upper and lower cutting wheels and a pair of shafts for rotatably mounting said cutting wheels adjacent to said edge guide, said shafts being disposed respectively above and below said base plate;

(i) an auxiliary roller for urging envelopes against said edge guide; and (j) means for rotatably mounting said auxiliary roller below said base plate in rolling contact with the belt portion trained around said second pulley.

* * * * *